US007794307B2

(12) United States Patent
Fujita et al.

(10) Patent No.: US 7,794,307 B2
(45) Date of Patent: Sep. 14, 2010

(54) METHOD FOR CORRECTING SEMI-CONDUCTIVE BELT

(75) Inventors: Tokio Fujita, Osaka (JP); Toshihiko Tomita, Osaka (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 11/649,823

(22) Filed: Jan. 5, 2007

(65) Prior Publication Data

US 2008/0166956 A1 Jul. 10, 2008

(51) Int. Cl.
*B24B 1/00* (2006.01)

(52) U.S. Cl. ..... 451/53; 451/54; 451/55

(58) Field of Classification Search ..... 451/53, 451/54, 167, 184, 246, 300, 28, 55, 231; 264/162

See application file for complete search history.

(56) References Cited

U.S. PATENT DOCUMENTS 5,058,657 A * 10/1991 Hasegawa et al. ..... 164/428
5,549,510 A * 8/1996 Fukuda et al. ..... 451/246
6,468,133 B1 * 10/2002 Dettling et al. ..... 451/28
6,497,793 B1 * 12/2002 Ahonen et al. ..... 162/361
7,204,005 B2 * 4/2007 Fukada et al. ..... 29/407.05
2003/0111764 A1 * 6/2003 Nagashima ..... 264/212

FOREIGN PATENT DOCUMENTS

| | | |
|---|---|---|
| JP | 10-171259 | 6/1998 |
| JP | 2000-89579 A | 3/2000 |
| JP | 2001-175085 A | 6/2001 |
| JP | 2002-365926 A | 12/2002 |
| JP | 2004-12766 A | 1/2004 |
| JP | 2004-233970 A | 8/2004 |

OTHER PUBLICATIONS

European Search Report dated Jun. 11, 2007.
Chinese Office Action dated Feb. 27, 2009.
Korean Office Action dated Aug. 17, 2009.

* cited by examiner

*Primary Examiner*—Eileen P. Morgan
(74) *Attorney, Agent, or Firm*—Sughrue Mion, PLLC

(57) ABSTRACT

The present invention provides a method for correcting a semi-conductive belt, the semi-conductive belt including a resin and a conductive substance, the method having grinding a geometrically defective part of the semi-conductive belt to flatten the geometrically defective part.

5 Claims, 1 Drawing Sheet

METHOD FOR CORRECTING SEMI-CONDUCTIVE BELT

FIELD OF THE INVENTION

The present invention relates a method for correcting a semi-conductive belt that comprises a resin and a conductive substance comprises grinding a geometrically defective part of the semi-conductive belt to flatten the geometrically defective part. Particularly, the method is useful as a method for correcting a seamless intermediate transfer belt or a transfer-convey belt, which is used in electrophotographic recording devices such as printers, copying machines, and video printers.

BACKGROUND OF THE INVENTION

Heretofore, as semi-conductive belts usable as intermediate transfer belts for electrophotographic recording devices, there has been known semi-conductive belts using films formed of vinylidene fluoride, ethylene-tetrafluoroethylene copolymers, polycarbonates, and the like. Moreover, in order to solve problems of crack generation at edge parts of the belts owing to insufficient mechanical properties such as strength, friction resistance and wear resistance, deformation of transferred images owing to deformation by load at driving, and the like, there has been known a belt wherein volume resistivity is controlled to 1 to $10^{13}$ Ω·cm by mixing a conductive substance into a polyimide film.

The semi-conductive belts as above are generally produced by a method wherein a starting solution containing a resin, a conductive substance, a solvent, and the like is seamlessly applied to inside of a cylindrical mold and then is dried and cured to form a film.

However, in the production method as described above, at the time when the belt is peeled from the mold, there is a case that a geometrically defective part such as a small protrusion and/or fold may formed on the belt surface. With recent developments in high-quality and high-speed electrophotographic recording devices, a belt having such a defective part causes troubles in images and thus cannot be used as an intermediate transfer belt or a transfer-convey belt, so that a product yield becomes worse at the production of a semi-conductive belt.

Thus, the present applicant has invented a method for correcting a semi-conductive belt capable of enhancing a product yield by subjecting the belt to heat treatment to flatten it even when a geometrically defective part is generated at the production step or the like (see, Reference 1).

[Reference 1] JP-A-2002-365926

However, the method for correcting a semi-conductive belt wherein a geometrically defective part is flattened by heat treatment alone cannot completely flatten all geometrically defective parts and thus there exists room for improving a product yield.

SUMMARY OF THE INVENTION

An object of the invention is to provide a method for correcting a semi-conductive belt capable of correcting a geometrically defective part by flattening the part to such a condition that no problem is practically observed as compared with the conventional method of correction by heat treatment and enhancing a product yield as compared with the method of correction by heat treatment.

As a result of extensive studies for achieving the above object, the present inventors have found that a semi-conductive belt can be corrected to such a condition that no problem is practically observed by grinding a geometrically defective part thereof or grinding the part after subjecting it to heat treatment and can be transformed into a good product as compared with the method of correction by heat treatment alone. Thus, they have accomplished the invention.

Namely, in the first aspect of the invention, a method for correcting a semi-conductive belt that comprises a resin and a conductive substance comprises grinding a geometrically defective part of the semi-conductive belt to flatten the geometrically defective part.

According to the method for correcting a semi-conductive belt of the first aspect of the invention, the geometrically defective part can be ground and flattened. As a result, a semi-conductive belt can be corrected to such a condition that no problem is practically observed, that is, transferred images are improved when used as an intermediate transfer belt. Thus, the belt can be transformed into a good product as compared with the method of correction by heat treatment.

Moreover, in the second aspect of the invention, the method for correcting a semi-conductive belt according to the first aspect of the invention further comprises subjecting the geometrically defective part to a heat treatment before the grinding.

According to the second aspect of the invention, the remaining defective part which has not been able to be corrected by heat treatment can be ground and flattened. As a result, a semi-conductive belt can be corrected to such a condition that no problem is practically observed, that is, transferred images are improved when used as an intermediate transfer belt. Thus, the belt can be transformed into a good product as compared with the method of correction by grinding.

Moreover, in the third or fourth aspect of the invention, in the method for correcting a semi-conductive belt according to the first or second aspect of the invention, respectively, the semi-conductive belt is supported with a rotatable supporting roll in a state that a tensile force is imparted to the semi-conductive belt, and the grinding or the heat treatment, respectively, is carried out in a state that the supporting roll internally contacts the geometrically defective part exists.

According to the third or fourth aspect of the invention, since the supporting roll internally touches the geometrically defective part, only the geometrically defective part is subjected to heat treatment and grinding treatment. Moreover, since a tensile force is imparted, the part can be conveniently ground without bending of the semi-conductive belt. Furthermore, since a tensile force is imparted by hooking the semi-conductive belt on the supporting roll, the geometrically defective part can be easily visually confirmed by conveniently rotating the semi-conductive belt.

Moreover, the invention is particularly effective in the case that the geometrical defect part has a protrusive shape. The geometrically defective part generated in the process of the production of the semi-conductive belt is mainly protrusive and a belt containing a protrusive defective part is fatally defective one, which cannot be used as a transcription belt. According to the correction method of the invention, the protrusion that is a fatal defect can be flattened and the belt can be transformed into a good product.

Furthermore, in the invention, it is more preferred that the grinding is carried out with a plurality of grinders in a stepwise manner. The stepwise grinding with different grinding means can efficiently flatten the part within a short period of time and also results in a good grinding accuracy (finishing accuracy). For example, the part can be accurately flattened within a short period of time by roughly grinding it using a rough grinding means at a first stage of grinding and then giving the finishing touches using a grinding means for precise touch at a second stage of grinding.

In the above, the heat treatment is preferably carried out at a temperature of 150 to 350° C. When the temperature for heat treatment is much lower than 150° C., the correction of the defective part becomes insufficient. When the temperature is much higher than 350° C., deformation other than flattening tends to occur and thus transferred images may be influenced.

Figure 1A:
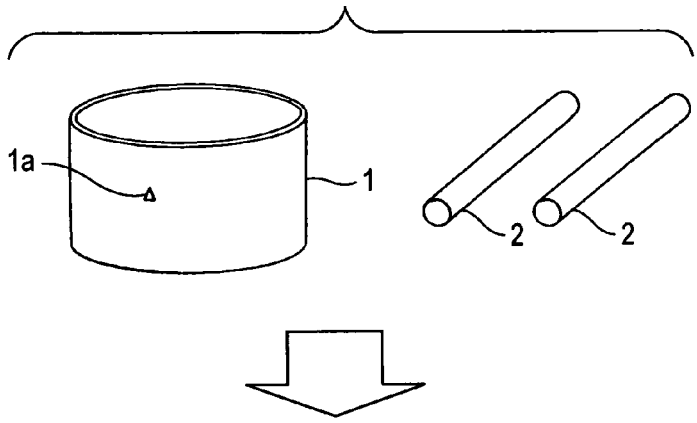
FIGS. 1A to 1C are figures illustrating the correction method in an embodiment.

The reference numerals used in the drawings denote the followings, respectively.

1 semi-conductive belt
1*a* protrusive defective part
2 cylindrical supporting roll
3 soldering iron
4 rubber whetstone
5 rooter

DETAILED DESCRIPTION OF THE INVENTION

The following will describe modes for carrying out the invention. As the semi-conductive belt for use in the invention, any semi-conductive belts hitherto known may be used as far as they contain a conductive substance in a resin. Examples of the belts include those containing, as a resin component, a vinylidene fluoride, an ethylene-tetrafluoroethylene copolymer, a polycarbonate, as well as, a heat-resistant resin such as a polyimides, a polyamideimide, a polyether ether ketone, polyphenylene sulfide, or polybenzimidazole. Of these, a polyimide resin excellent in mechanical properties, heat resistance, and flexibility is most suitable.

As the conductive substance, there may be mentioned conductive polymers such as polyacetylene, polypyrrole, and polythiophene, carbons and graphite such as ketchen black and acetylene black, metals such as silver, nickel, and copper and alloys thereof, composite metals plated on mica, carbon, glass, and the like, metal oxides such as tin oxide and indium oxide, and anionic, cationic, nonionic, or amphoteric surfactants. In the invention, the semi-conductive belt may contain the other filler.

In the case of a semi-conductive belt containing the conductive substance in a polyimide resin, the semi-conductive belt can be obtained by obtaining a polyamidic acid polymer through polymerization of a diamine component with a dianhydride component in a solution and then mixing the polyamidic acid with carbon black or the like, followed by film formation thereof in a mold, drying under heating, and imidation. The method for correcting a semi-conductive belt of the invention is particularly effective in the case of a seamless belt from which a part including a defective part cannot be removed off.

The surface resistivity (ρs) of the semi-conductive belt thus obtained is generally from $10^8$ to $10^{16}$ Ω/□, the volume resistivity (ρv) is generally from $10^8$ to $10^{16}$ Ω·cm, and the belt generally has a thickness of 50 to 150 μm.

In the invention, a semi-conductive belt containing a geometrically defective part generated at the production step or the like is a target for the correction. As the geometrical defects, small folds, small protrusions, and the like may be mentioned, for example. They generate troubles (toner missing) in transferred images and the like, so that it becomes impossible to use the belt as an intermediate transfer belt or transfer-convey belt.

The following will describe an embodiment of the method for correcting a semi-conductive belt (hereinafter, simply referred to as a "belt") with reference to FIG. 1.

Figure 1B:
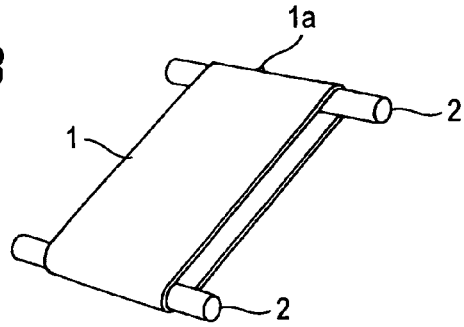

First, a tensile force is imparted to a protrusive defective part 1*a* of a belt 1. In FIG. 1, a protrusive defective part 1*a* is present in a belt 1 (see, FIG. 1A). Two supporting rolls 2 are inserted in the belt 1. On this occasion, the rolls are inserted so that the protrusive defective part 1*a* is located on the cylindrical supporting roll 2 (see, FIG. 1B).

Figure 1C:
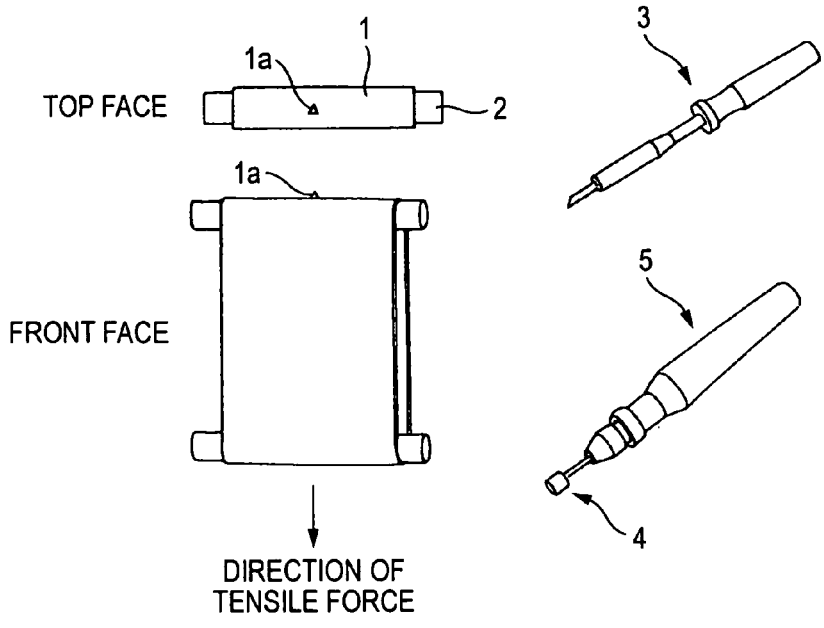

Then, one of the two cylindrical supporting rolls 2 is placed at an upper part and another one is placed at a perpendicularly lower part thereof so as to impart a tensile force to the belt 1 (see, FIG. 1C). The tensile force to be imparted to the belt is set within a range suitable for heat treatment and grinding. When the tensile force is low, the belt 1 is bent during heat treatment and grinding and the belt 1 is bruised. Moreover, when the tensile force is high, the belt 1 is excessively heated and ground, so that it is bruised. When the cylindrical supporting roll 2 is made of a metal, the tensile force may be a tensile force resulting from its own weight.

Next, the protrusive defective part 1*a* to which a tensile force is imparted is subjected to heat treatment.

The heating means for use in the heat treatment is not particularly limited but the use of a soldering iron 3 (see, FIG. 1), a heating roll, or the like is preferred.

The temperature for the heat treatment may be a temperature which enables flattening of the defective part but is preferably a temperature of 150° C. to 350° C. for the aforementioned reasons. Particularly, it is preferred to conduct the heat treatment at a temperature of 200° C. to 300° C. Moreover, in the case of a semi-conductive belt containing a polyimide resin as a resin component, the temperature is preferably a temperature equal to or lower than cure temperature of the belt and it is preferred to conduct the heat treatment at a temperature of 100° C. to 350°, particularly a temperature of 200° C. to 300° C.

In the case that a protrusive defective part 1*a* is subjected to heat treatment, the protrusive defective part 1*a* can be subjected to the heat treatment with holding the both surfaces of the belt between holding members having a smooth surface. As the holding member having a smooth surface, a planar plate form, a member having a curved surface along the shape of the belt, deformable plate form, or a film can be employed. The smooth surface may suitably have a surface flatter than the defective part but is preferably such a smooth one that the surface does not result in concavity and convexity on the surface of the semi-conductive belt. Specifically, as a convenient method, exemplified is a method wherein inside of the defective part is held by a plate made of a fluorinated resin or the like, a film is applied on the defective part, and heat treatment is conducted under pressing the film by a heating means.

In addition, there may be mentioned a method wherein a cylindrical holding member having an outer circumference smaller than the inner circumference of the semi-conductive belt (preferably one having an outer circumference slightly smaller than the inner circumference) is inserted into inside of the semi-conductive belt and, with confirming the position of the defective part, heat treatment is conducted under pressing the belt by a heating means, if necessary, with intervening an outer holding member. At that time, using one means both as an outer holding member and a heating means, the correction may be conducted. For example, preferred are a means possessing a freely rotatable heating roll having an elastic body layer on the surface and a means possessing a heating means inside a surface material forming a smooth surface along the smooth surface of the inner holding member. The surface material is preferably coated with a material having a sliding ability. In the invention, it is possible to heat the belt from its inner side.

Then, the protrusive defective part 1*a* to which a tensile force is imparted is ground.

At grinding, stepwise grinding of the belt by a plurality of grinding means is preferred rather than grinding by one kind of grinding means. Thereby, flattening by grinding can be achieved for a short period of time and also the belt can be accurately ground. For example, an accurate grinding can be achieved for a short period of time by roughly grinding the belt using a grinding means containing large-sized abrasive grains at the first stage of grinding and then precisely grinding it using a grinding means containing small-sized abrasive grains at the second stage of grinding. Furthermore, as a finish, the belt may be ground with a felt material. By the grinding with a felt material, the surface of flattened part can be polished.

The grinding means for use in the grinding can be suitably selected depending on the material, abrasive grains, shape, and the like and is not particularly limited but is preferably a rubber whetstone 4 wherein a rubber and a whetstone are mixed each other (see, FIG. 1). As the rubber whetstone 4, a commercially available rubber whetstone can be employed. Moreover, the rubber whetstone 4 includes, for example, whetstones for abrasion wherein the rubber is rather hard and the grain size of the abrasive grains is from #80 to #320 (hereinafter, the number is according to JIS R6001) and whetstones for polishing wherein the rubber is rather soft and the grain size of the abrasive grains is from #400 to #2000, and can be selected depending on the protrusive defective part. The shape of the rubber whetstone 4 may be, for example, cylindrical or artillery shell-shaped one and can be selected depending on the protrusive defective part. The rubber constituting the rubber whetstone 4 may be a natural rubber or a synthetic rubber and further may be constituted by silicone, urethane, or the like. Moreover, the component of the abrasive grains constituting the rubber whetstone 4 is not particularly limited and examples thereof include electrically molten alumina, silicon carbide, non-molten aluminum oxide ceramic, artificial diamond, cubic boron nitride, and the like.

Moreover, the driving device for rotating the whetstone is not particularly limited but is preferably a rooter 5 (see, FIG. 1). The rotation speed of the rotation-driving device is suitably set depending on the physical properties and thickness of the belt 1, conditions of the protrusive defective part 1*a* (e.g., size, etc.), kind of the whetstone, and the like. For example, the rotation speed of the rooter 5 is preferably from 100 to 50000 rpm, more preferably from 1000 to 20000 rpm.

Incidentally, the period of time for grinding is a period until the protrusive defective part 1*a* is ground and flattened by a grinding means and is suitably changed depending on factors such as the protrusive defective part 1*a*, grinding means, and rotation number of the rotation-driving device.

Furthermore, in the above embodiment, there is described the method for correction wherein the protrusive defective part 1*a* is subjected to heat treatment and then is ground and flattened. However, the method is not limited thereto and transformation to a good product can be achieved by a method for correction wherein the protrusive defective part 1*a* is ground and thereby flattened or a method for correction comprising heat treatment alone.

EXAMPLES

The present invention is now illustrated in greater detail with reference to Examples and Comparative Examples, but it should be understood that the present invention is not to be construed as being limited thereto. Incidentally, the evaluation items in Examples and Comparative Examples were performed as follows.

(1) Evaluation of Image Transfer Ability

The resulting semi-conductive belt after the correction was installed as an intermediate transfer belt into a commercially available copying machine and images were evaluated. The evaluation was ranked as follows: "good" in the case that clear and precise images were obtained; "no good" in the case that defect(s) or change(s) were observed in the images; and "slightly good" in the case that intermediary results therebetween were observed, which were improved as compared with the results obtained before the correction of the belt.

(2) Evaluation of Visually Observed Appearance

The conditions of the defective parts after the correction were visually evaluated. The evaluation was ranked as follows: "good" in the case that the defective part was flattened such an extent that the part was visually not confirmed; "slightly good" in the case that the protrusion was slightly confirmed; and "no good" in the case that the protrusion was obviously confirmed.

Example 1

A polyimide belt of an outer diameter of 300 mm and a thickness of 70 μm containing carbon black in a polyimide resin and having a surface resistivity of $5\times10^{12}$ Ω/□ was used, which had a protrusive defective part (conical protrusion of 3 mm, height of 0.2 mm) on the surface. Two cylindrical supporting rolls were inserted into the belt and a tensile force was imparted in a hung state. The defective part was moved onto the cylindrical part and was ground so as to abrade the top of the protrusive defective part using a rooter fitted with a rubber whetstone (grain size #500). The rotation number of the rooter was set at 13000 rpm and the grinding time was from 5 to 10 seconds. As a result, it was visually observed that the protrusive defective part on the belt surface slightly remained as shown in Table 1 but no trouble was observed on the images.

Example 2

A tensile force was imparted to a belt having a protrusive defective part (conical protrusion of 3 mm, height of 0.2 mm) on the surface under the same conditions as in Example 1. The defective part was moved onto the cylindrical part and the defective part was subjected to heat treatment by slightly pushing it with a soldering iron at 250° C. for 5 to 7 seconds. Thereafter, the heat-treated protrusive defective part was ground using a rooter fitted with a rubber whetstone (grain size #500). The rotation number of the rooter was set at 13000 rpm and the grinding time was from 5 to 10 seconds. As a result, the protrusive defective part on the belt surface was flattened to such an extent that the part was not visually confirmed as shown in Table 1. Also, no trouble was observed on the images.

Comparative Example 1

A tensile force was imparted to a belt having a protrusive defective part (conical protrusion of 3 mm, height of 0.2 mm) on the surface under the same conditions as in Example 1. The defective part was moved onto the cylindrical part and the defective part was subjected to heat treatment by slightly pushing it with a soldering iron at 250° C. for 5 to 7 seconds. As a result, it was visually observed that the protrusive defective part on the belt surface slightly remained as shown in Table 1 but images were slightly improved as compared with the case of Comparative Example 2 where no correction was conducted.

Comparative Example 2

A polyimide belt of an outer diameter of 300 mm and a thickness of 70 μm containing carbon black in a polyimide resin and having a surface resistivity of $5\times10^{12}$ Ω/□, which had a protrusive defective part (conical protrusion of 3 mm, height of 0.2 mm) on the surface, was subjected to image evaluation without any correction. As a result, image troubles resulting from the defective part were observed.

TABLE 1

| | Evaluation of images | Appearance |
|---|---|---|
| Example 1 | good | slightly good |
| Example 2 | good | good |
| Comparative Example 1 | slightly good | slightly good |
| Comparative Example 2 | no good | no good |

Evaluation of Ratio of Transformation into Good Products

Fifty pieces of inferior product belts having a protrusive defective part were corrected by respective correction methods. In this case, evaluation was conducted on a ratio of transformation into good products through correction, i.e., a ratio of good products transformed by correcting the inferior products. The ratio of transformation into good products through correction is a ratio of number of good products transformed with respect to number of the inferior products. The evaluation results are shown in Table 2. The ratio of transformation into good products through correction obtained by the correction method wherein heat treatment and grinding were combined was found to be 90%, which was the best result. As a next result, the ratio of transformation into good products through correction resulting from the method of correction by grinding was found to be 75%, and the worst result was a ratio of transformation into good products through correction of 50%, which resulted from the method of correction by heat treatment.

TABLE 2

| | Ratio of transformation into good products through correction |
|---|---|
| Grinding | 75% |
| Heat treatment + grinding | 90% |
| Heat treatment | 50% |

While the present invention has been described in detail and with reference to specific embodiments thereof, it will be apparent to one skilled in the art that various changes and modifications can be made therein without departing from the spirit and scope thereof.

The present application is based on Japanese Patent Application No. 2005-197805 filed on Jul. 6, 2005, and the contents thereof are incorporated herein by reference.

What is claimed is:

1. A method for correcting a semi-conductive belt, the semi-conductive belt comprising a resin and a conductive substance, the method comprising:

supporting the semi-conductive belt such that the belt is supported with a rotatable supporting roll in a state that a tensile force is imparted to the semi-conductive belt;

subjecting the geometrically defective part to a heat treatment, wherein the heat treatment is carried out in a state that the supporting roll contacts an inner surface of the belt opposite the geometrically defective part;

grinding the heat treated geometrically defective part of the semi-conductive belt to flatten the geometrically defective part wherein the grinding is carried out in a state that the supporting roll contacts an inner surface of the belt opposite the geometrically defective part, wherein grinding is carried out with the belt being in the state of tensile force and wherein the supporting roll is not rotated.

2. The method for correcting a semi-conductive belt according to claim 1, wherein the geometrical defect part has a protrusive shape.

3. The method for correcting a semi-conductive belt according to claim 1, wherein the grinding is carried out with a plurality of grinders in a stepwise manner.

4. The method for correcting a semi-conductive belt according to claim 1, wherein the heat treatment is carried out at a temperature of 150 to 350° C.

5. The method for correcting a semi-conductive belt according to claim 1, wherein the grinding is carried out using a rubber wetstone.

* * * * *